US011244638B2

(12) United States Patent
Tsai et al.

(10) Patent No.: US 11,244,638 B2
(45) Date of Patent: Feb. 8, 2022

(54) TRACE STRUCTURE OF DISPLAY PANEL

(71) Applicant: E Ink Holdings Inc., Hsinchu (TW)

(72) Inventors: Xue-Hung Tsai, Hsinchu (TW); Wei-Tsung Chen, Hsinchu (TW); Po-Hsin Lin, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 0 days.

(21) Appl. No.: 17/189,277

(22) Filed: Mar. 2, 2021

(65) Prior Publication Data

US 2021/0272527 A1 Sep. 2, 2021

(30) Foreign Application Priority Data

Mar. 2, 2020 (TW) ..... 109106660

(51) Int. Cl.
*G09G 3/34* (2006.01)

(52) U.S. Cl.
CPC ..... *G09G 3/344* (2013.01); *G09G 2330/028* (2013.01)

(58) Field of Classification Search
CPC ..... G09G 2300/0426; G09G 3/344; G09G 2330/028; G02F 1/13452
See application file for complete search history.

(56) References Cited

U.S. PATENT DOCUMENTS 9,585,252 B2 2/2017 Yeo et al.
2008/0001892 A1* 1/2008 Kim ..... G02F 1/13458 345/97
2015/0206479 A1* 7/2015 Maeda ..... G09G 3/344 345/107
2017/0278469 A1* 9/2017 Iwami ..... G09G 3/3648

FOREIGN PATENT DOCUMENTS

TW 200701847 1/2007

OTHER PUBLICATIONS

"Office Action of Taiwan Counterpart Application", dated Sep. 10, 2020, p. 1-p. 4.

* cited by examiner

*Primary Examiner* — Priyank J Shah
(74) *Attorney, Agent, or Firm* — JCIPRNET

(57) ABSTRACT

A trace structure of a display panel including a first metal layer and a second metal layer is provided. The first metal layer is configured to transmit a first voltage. The second metal layer is disposed under the first metal layer and configured to transmit a second voltage. The first metal layer and the second metal layer form the trace structure on the display panel, such that the trace structure has a capacitor structure. The trace structure is configured to connect a power input and a panel driver circuit.

9 Claims, 3 Drawing Sheets

TRACE STRUCTURE OF DISPLAY PANEL

CROSS-REFERENCE TO RELATED APPLICATION

This application claims the priority benefit of Taiwan application serial no. 109106660, filed on Mar. 2, 2020. The entirety of the above-mentioned patent application is hereby incorporated by reference herein and made a part of this specification.

BACKGROUND

Technical Field

The invention relates to a trace structure, and particularly relates to a trace structure of a display panel.

Description of Related Art

In a display panel, there are various ways to resolve a problem of circuit burnout caused by excessive electrical over stress (EOS). One way is to place a capacitor next to a panel driver circuit, and a placement position thereof should be as close to the circuit as possible, and another way is to change a framework of a circuit design. However, the way of placing the capacitor next to the panel driver circuit is simpler and easier for verification. In the related art, the panel driver circuit may be disposed on a display panel in a chip on glass (COG) manner where the panel driver circuit is directly disposed on glass or in a chip on film (COF) manner where the panel driver circuit is disposed on a flexible circuit board. However, in the former configuration, it is not possible to place the capacitor next to the panel driver circuit, and the latter configuration requires a change to be made to a package design.

Therefore, in the related art, it is difficult to resolve the problem of circuit burnout caused by electrical over stress.

SUMMARY

The invention is directed to a trace structure of a display panel, which is adapted to resolve a problem of circuit burnout caused by electrical over stress.

The invention provides a trace structure of a display panel including a first metal layer and a second metal layer. The first metal layer is configured to transmit a first voltage. The second metal layer is disposed under the first metal layer and is configured to transmit a second voltage. The first metal layer and the second metal layer form the trace structure on the display panel, such that the trace structure has a capacitor structure. The trace structure is configured to connect a power input and a panel driver circuit.

In an embodiment of the invention, the power input transmits the first voltage and the second voltage to the panel driver circuit through the trace structure.

In an embodiment of the invention, the first voltage is selected from one of a first power voltage and a second power voltage. The first power voltage is greater than the second power voltage.

In an embodiment of the invention, the second voltage is a ground voltage.

In an embodiment of the invention, the trace structure further includes a third metal layer. The third metal layer is disposed on the first metal layer. The third metal layer is configured to transmit a third voltage.

In an embodiment of the invention, the third voltage is a ground voltage.

In an embodiment of the invention, the display panel includes a display area and a non-display area. The panel driver circuit is disposed in the non-display area.

In an embodiment of the invention, the panel driver circuit is a gate driver integrated circuit.

In an embodiment of the invention, the display panel is an electronic paper display panel.

Based on the above description, in the embodiment of the invention, the trace structure of the display panel has a capacitor structure, which can resolve the problem of circuit burnout caused by electrical over stress.

To make the aforementioned more comprehensible, several embodiments accompanied with drawings are described in detail as follows.

DESCRIPTION OF THE EMBODIMENTS

Figure 1:
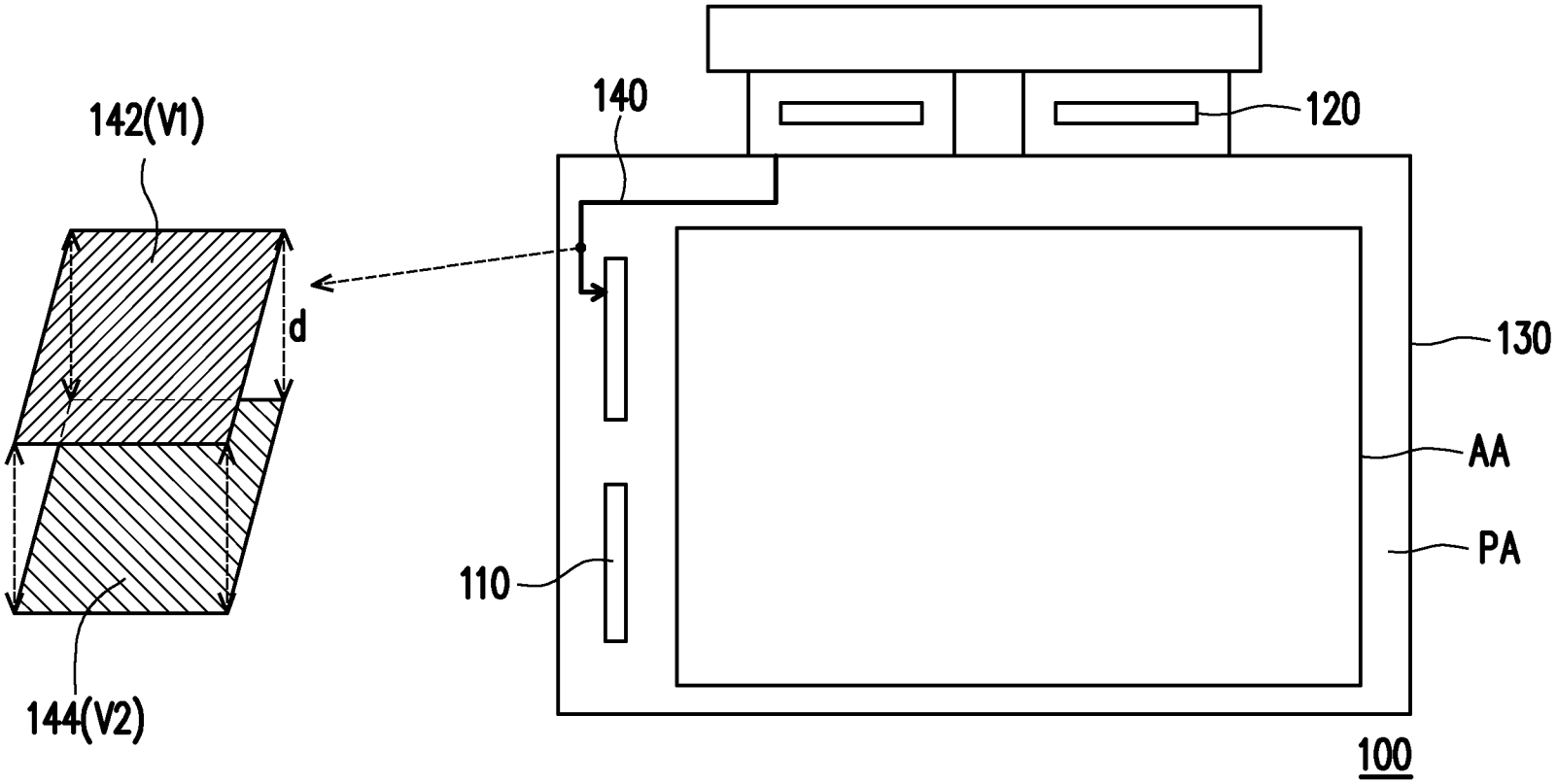
FIG. 1 is a schematic diagram of a display device and a trace structure on a display panel thereof according to an embodiment of the invention.

FIG. 1 is a schematic diagram of a display device and a trace structure on a display panel thereof according to an embodiment of the invention. Referring to FIG. 1, the display device 100 of the embodiment includes a gate driver integrated circuit 110, a power input 120 and a display panel 130. The display panel 130 includes a display area AA and a non-display area PA. The gate driver integrated circuit 110 and the power input 120 are configured to drive the display panel 130 to display images on the display area AA thereof. In an embodiment, the display device 100 is, for example, an electronic paper display device, and the display panel 130 is, for example, an electronic paper display panel. In the embodiment, the gate driver integrated circuit 110 (gate driver IC) is an example of a panel driver circuit, but the invention is not limited thereto. The panel driver circuit may also be another driver circuit, as long as it is used to drive the display panel. Two ends of a trace structure 140 may also be connected to a source driver circuit by one end and connected to the power input by the other end.

In the embodiment, the power input 120 is, for example, connected to the display panel 130 through a flexible printed circuit board. The gate driver integrated circuit 110 and the trace structure 140 are disposed in the non-display area PA. The non-display area PA is an area outside the display area AA for configuring peripheral circuits. The trace structure 140 is configured to connect the power input 120 and the gate driver integrated circuit 110. The power input 120 transmits a first voltage V1 and a second voltage V2 required for operation of the gate driver integrated circuit 110 to the gate driver integrated circuit 110 through the trace structure 140. The trace structure 140 includes a first metal layer 142 and a second metal layer 144. The second metal layer 144 is disposed under the first metal layer 142. The first metal layer 142 is configured to transmit the first voltage V1, and the second metal layer 144 is configured to transmit the second voltage V2.

In the embodiment, the trace structure 140 is, for example, a gate power rail. The first voltage V1 is selected from one of a first power voltage and a second power voltage, wherein the first power voltage is greater than the second power voltage. The first power voltage is, for example, a high power voltage required for operation of the gate driver integrated circuit 110, and the second power voltage is, for example, a low power voltage required for operation of the gate driver integrated circuit 110. The second voltage V2 is, for example, a ground voltage.

In the embodiment, the first metal layer 142 and the second metal layer 144 form the trace structure 140 on the display panel 130, so that the trace structure 140 has a capacitor structure, which may resolve the problem of circuit burnout caused by electrical over stress (EOS). A capacitance value of the capacitor structure is, for example, between a few nanofarads (nF) and a few microfarads (μF). In an embodiment, if the trace structure 140 has a capacitance value of 1 μF, the electrical over stress may be reduced from 52 volts to 34 volts. The above values are only for an illustrative purpose and are not used to be limiting of the invention.

Figure 2:
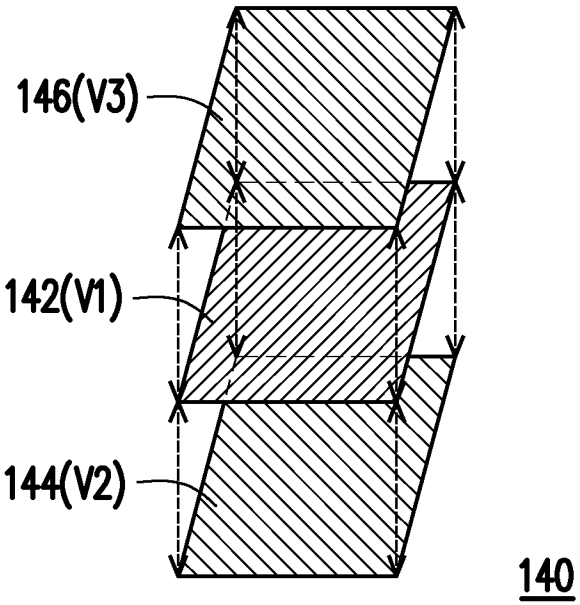
FIG. 2 is a schematic diagram of a trace structure on a display panel according to another embodiment of the invention.

FIG. 2 is a schematic diagram of a trace structure on a display panel according to another embodiment of the invention. Referring to FIG. 2, the trace structure 140 of the embodiment of the invention includes a first metal layer 142, a second metal layer 144, and a third metal layer 146. The second metal layer 144 is disposed under the first metal layer 142. The third metal layer 146 is disposed above the first metal layer 142. The first metal layer 142 is configured to transmit the first voltage V1, the second metal layer 144 is configured to transmit the second voltage V2, and the third metal layer 146 is configured to transmit a third voltage V3. The third voltage V3 is, for example, a ground voltage.

Figure 3B:
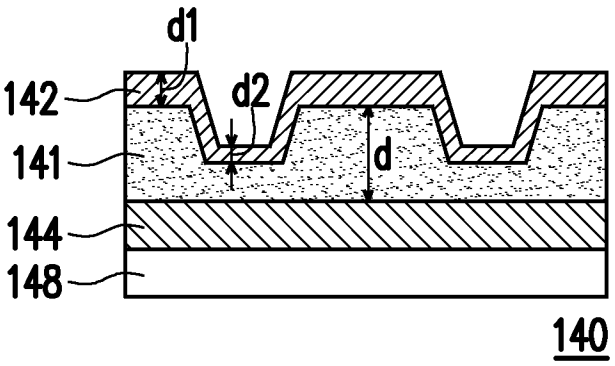
FIG. 3A and FIG. 3B are flowcharts of steps for fabricating a trace structure on a display panel according to an embodiment of the invention.
Figure 3A:
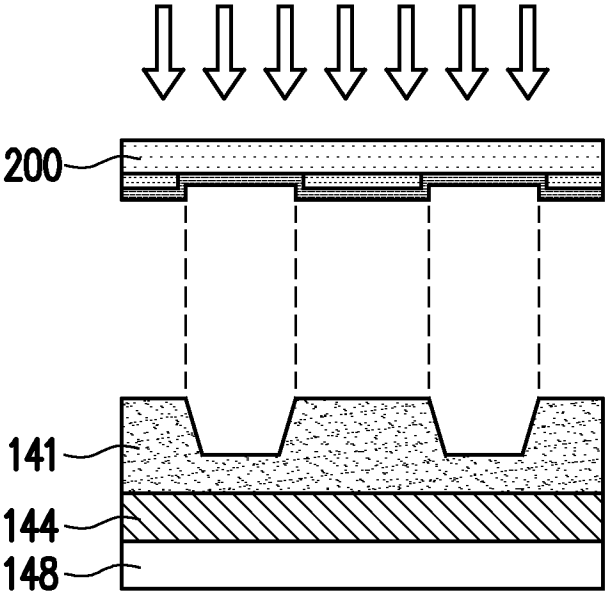

FIG. 3A and FIG. 3B are flowcharts of steps for fabricating a trace structure on a display panel according to an embodiment of the invention. Referring to FIG. 3A and FIG. 3B, in the step of FIG. 3A, a first metal layer 142 is formed on a substrate 148 having a second metal layer 144 by using a halftone mask 200, shown as the step of FIG. 3B. In the embodiment, the trace structure 140 has a dielectric layer 141 with a thickness d between the first metal layer 142 and the second metal layer 144 to form a capacitor structure. The thicknesses of the dielectric layer 141 may be the same or different. In addition, in the embodiment, thicknesses d1 and d2 of the first metal layer 142 at different positions may be the same or different. A designer may adjust the thickness of the dielectric layer 141 according to a requirement of the capacitance value.

In summary, in the embodiment of the invention, the capacitor structure is constructed in the trace structure of the display panel, which is adapted to resolve the problem of circuit burnout caused by electrical over stress.

It will be apparent to those skilled in the art that various modifications and variations can be made to the disclosed embodiments without departing from the scope or spirit of the invention. In view of the foregoing, it is intended that the invention covers modifications and variations provided they fall within the scope of the following claims and their equivalents.

What is claimed is:

1. A trace structure of a display panel, comprising:

a first metal layer, configured to transmit a first voltage;

a second metal layer, disposed under the first metal layer, and configured to transmit a second voltage, wherein the first metal layer and the second metal layer form the trace structure on the display panel, such that the trace structure has a capacitor structure, and the trace structure is configured to connect a power input and a panel driver circuit; and a dielectric layer, disposed between the first metal layer and the second metal layer, wherein the dielectric layer has thick portions and thin portions, the thick portions and the thin portions are alternately arranged, and the first metal layer is disposed on the thick portions and the thin portions.

2. The trace structure of the display panel as claimed in claim 1, wherein the power input transmits the first voltage and the second voltage to the panel driver circuit through the trace structure.

3. The trace structure of the display panel as claimed in claim 1, wherein the first voltage is selected from one of a first power voltage and a second power voltage, and the first power voltage is greater than the second power voltage.

4. The trace structure of the display panel as claimed in claim 1, wherein the second voltage is a ground voltage.

5. The trace structure of the display panel as claimed in claim 1, further comprising a third metal layer disposed on the first metal layer, wherein the third metal layer is configured to transmit a third voltage.

6. The trace structure of the display panel as claimed in claim 5, wherein the third voltage is a ground voltage.

7. The trace structure of the display panel as claimed in claim 1, wherein the display panel comprises a display area and a non-display area, and the panel driver circuit is disposed in the non-display area.

8. The trace structure of the display panel as claimed in claim 1, wherein the display panel is an electronic paper display panel.

9. The trace structure of the display panel as claimed in claim 1, wherein the panel driver circuit is a gate driver integrated circuit.

* * * * *